US008353273B2

(12) United States Patent
Mc Lain et al.

(10) Patent No.: US 8,353,273 B2
(45) Date of Patent: Jan. 15, 2013

(54) METHOD AND SYSTEM FOR CORRELATING A PRESSURE SENSOR FOR A FUEL SYSTEM

(75) Inventors: Kurt D. Mc Lain, Clarkston, MI (US); William R. Cadman, Fenton, MI (US); David Edward Prout, Linden, MI (US); Miles K. Maxey, Holly, MI (US); Robert Jackson, Brighton, MI (US); Kenneth J. Kalvelage, Rochester Hills, MI (US)

(73) Assignee: GM Global Technology Operations LLC

( * ) Notice: Subject to any disclaimer, the term of this patent is extended or adjusted under 35 U.S.C. 154(b) by 386 days.

(21) Appl. No.: 12/683,772

(22) Filed: Jan. 7, 2010

(65) Prior Publication Data

US 2011/0011472 A1 Jan. 20, 2011

Related U.S. Application Data

(60) Provisional application No. 61/225,331, filed on Jul. 14, 2009.

(51) Int. Cl.
*F02M 33/02* (2006.01)

(52) U.S. Cl. ..... 123/518; 123/690

(58) Field of Classification Search ..... 123/518, 123/520, 690, 698, 198 D; 701/114
See application file for complete search history.

(56) References Cited

U.S. PATENT DOCUMENTS

| | | | | |
|---|---|---|---|---|
| 5,895,859 | A * | 4/1999 | Sawada et al. | 73/706 |
| 6,363,921 | B1 * | 4/2002 | Cook et al. | 123/520 |
| 6,467,463 | B2 * | 10/2002 | Kitamura et al. | 123/516 |
| 6,526,760 | B2 * | 3/2003 | Fickel et al. | 62/7 |
| 6,536,261 | B1 * | 3/2003 | Weldon et al. | 73/49.7 |
| 6,874,523 | B2 * | 4/2005 | Yoshihara et al. | 137/202 |
| 6,970,775 | B2 * | 11/2005 | Lederle et al. | 73/40 |
| 7,066,152 | B2 * | 6/2006 | Stroia et al. | 123/467 |
| 7,107,971 | B2 * | 9/2006 | Spink et al. | 123/520 |
| 7,441,545 | B1 * | 10/2008 | Fisher et al. | 123/467 |
| 2003/0226549 | A1 | 12/2003 | Takagi et al. | |
| 2004/0089063 | A1 | 5/2004 | Matsubara et al. | |

FOREIGN PATENT DOCUMENTS

DE 10245158 A1 4/2003

OTHER PUBLICATIONS

Office Action for De Patent Application 10 2010 026 655.8 dated Mar. 14, 2012, 6 pages.

* cited by examiner

*Primary Examiner* — John Kwon

(57) ABSTRACT

A control module and method for operating the same includes a diurnal control valve module that opens a diurnal control valve (DCV) and an evaporative leak check module (ELCM) diverter valve control module that switches on an ELCM diverter valve. The control module includes a correlation module performs a correlation of a ELCM pressure signal and a fuel tank pressure signal and that generates a fault signal in response to the correlation when the DCV valve is open and the ELCM diverter valve is on.

20 Claims, 3 Drawing Sheets

METHOD AND SYSTEM FOR CORRELATING A PRESSURE SENSOR FOR A FUEL SYSTEM

CROSS-REFERENCE TO RELATED APPLICATIONS

This application claims the benefit of U.S. Provisional Application No. 61/225,331, filed on Jul. 14, 2009. The disclosure of the above application is incorporated herein by reference in its entirety.

FIELD

The present disclosure relates to a fuel system for a vehicle and more particularly to determining an error in a pressure sensor of a fuel system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel (A/F) mixture within cylinders to drive pistons and to provide drive torque. Air is delivered to the cylinders via a throttle and an intake manifold. A fuel injection system supplies fuel from a fuel tank to provide fuel to the cylinders based on a desired A/F mixture. To prevent release of fuel vapor, a vehicle may include an evaporative emissions system which includes a canister that absorbs fuel vapor from the fuel tank, a canister vent valve, and a purge valve. The canister vent valve allows air to flow into the canister. The purge valve supplies a combination of air and vaporized fuel from the canister to the intake system.

Closed-loop control systems adjust inputs of a system based on feedback from outputs of the system. By monitoring the amount of oxygen in the exhaust, closed-loop fuel control systems manage fuel delivery to an engine. Based on an output of oxygen sensors, an engine control module adjusts the fuel delivery to match an ideal A/F ratio (14.7 to 1). By monitoring engine speed variation at idle, closed-loop speed control systems manage engine intake airflows and spark advance.

Typically, the fuel tank stores liquid fuel such as gasoline, diesel, methanol, or other fuels. The liquid fuel may evaporate into fuel vapor which increases pressure within the fuel tank. Evaporation of fuel is caused by energy transferred to the fuel tank via radiation, convection, and/or conduction. An evaporative emissions control (EVAP) system is designed to store and dispose of fuel vapor to prevent release. More specifically, the EVAP system returns the fuel vapor from the fuel tank to an engine for combustion therein. The EVAP system is a sealed system to meet zero emission requirements. More specifically, the EVAP system may be implemented in a plug-in hybrid vehicle with minimum engine operation that stores fuel vapor prior to being purged to the engine.

The EVAP system includes an evaporative emissions canister (EEC), a purge valve, and a diurnal control valve. When the fuel vapor increases within the fuel tank, the fuel vapor flows into the EEC. The purge valve controls the flow of the fuel vapor from the EEC to the intake manifold. The purge valve may be modulated between open and closed positions to adjust the flow of fuel vapor to the intake manifold.

Determining whether a fuel leak occurs is important in a closed system. However, adding additional pressure sensors increases the cost of the system.

SUMMARY

The present disclosure provides a method and system for determining the accuracy of a fuel tank pressure sensor using components found in a vehicle fuel system.

In one aspect of the disclosure, a method includes opening a diurnal control valve, switching on an ELCM diverter valve, generating a fuel tank pressure signal, generating an ELCM pressure signal, correlating the ELCM pressure signal and the fuel tank pressure signal and generating a fault signal in response to correlating.

In another aspect of the disclosure, a control module includes a diurnal control valve module that opens a diurnal control valve and an ELCM diverter valve control module that switches on an ELCM diverter valve. The control module includes a correlation module performs a correlation of a ELCM pressure signal and a fuel tank pressure signal and that generates a fault signal in response to the correlation when the DCV valve is open and the ELCM diverter valve is on.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
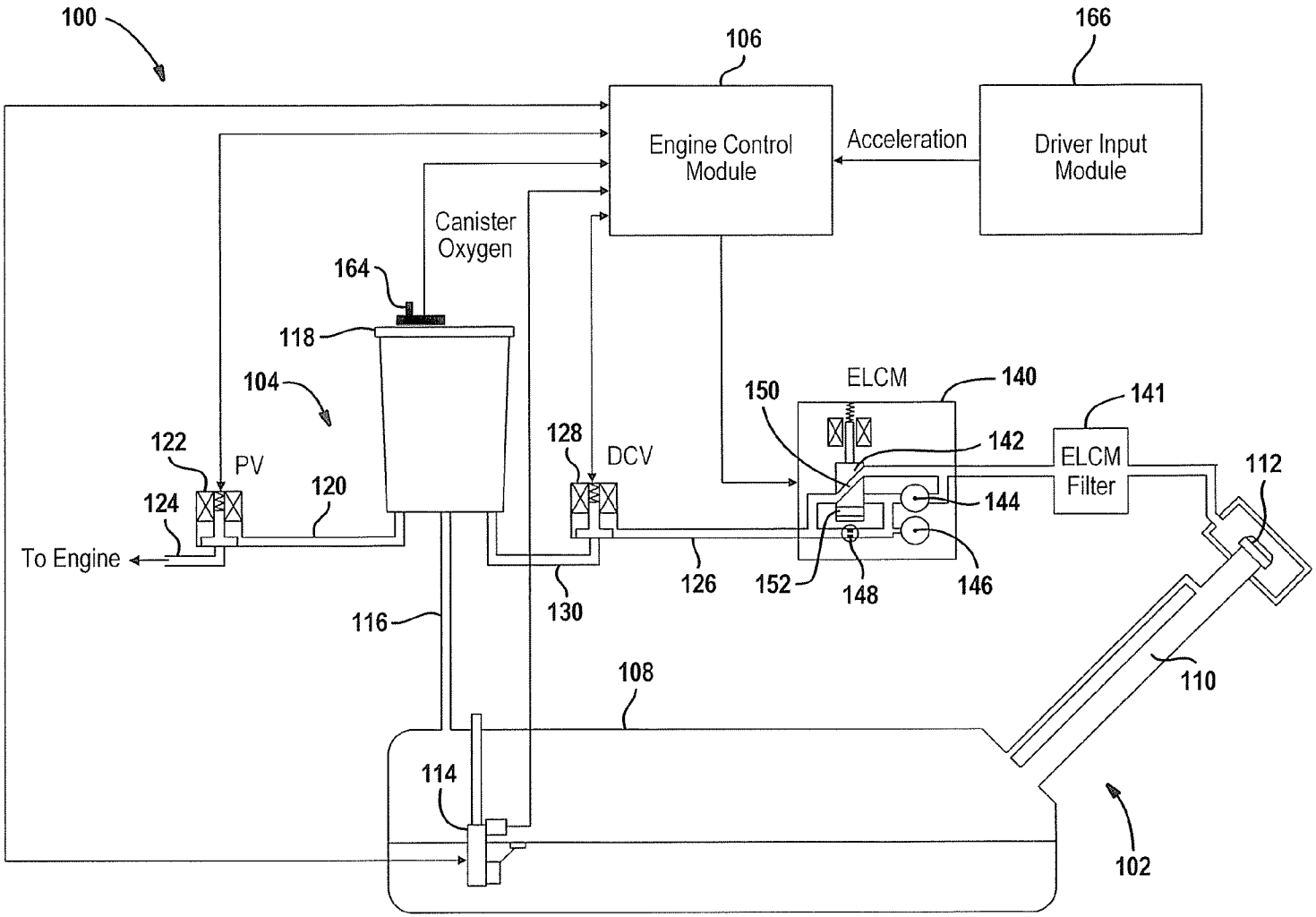
FIG. 1 is a functional block diagram of an engine system of a vehicle according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a functional block diagram of an exemplary engine system 100 of a vehicle is shown. The engine system may be for a conventional Spark-ignited (SI) engine, a Homogeneous Charge Compression Ignited (HCCI) engine or an extended range electric vehicle engine which is used as a generator for generating electric power for charging a battery pack. The engine system 100 includes a fuel system 102, an EVAP system 104, and an engine control module 106. The fuel system 102 includes a fuel tank 108, a fuel inlet 110, a fuel cap 112, and a modular reservoir assembly (MRA) 114. The MRA 114 is disposed within the fuel tank 108 and pumps liquid fuel to a fuel injection system (not shown) of the engine system 100 to be combusted. A fuel tank pressure sensor 164 generates a fuel tank pressure signal corresponding to the pressure within the fuel tank.

The EVAP system 104 includes a fuel vapor line 116, a canister 118, a fuel vapor line 120, a purge valve (PV) 122, a fuel vapor line 124, an air line 126, a diurnal control valve (DCV) 128, and an air line 130.

The fuel tank 108 contains liquid fuel and fuel vapor. The fuel inlet 110 extends from the fuel tank 108 to enable fuel filling. The fuel cap 112 closes the fuel inlet 110.

Fuel vapor flows through the fuel vapor line 116 into the canister 118, which stores the fuel vapor. The fuel vapor line 120 connects the canister 118 to the PV 122, which is initially closed in position. The engine control module 106 controls the PV 122 to selectively enable fuel vapor to flow through the fuel vapor line 124 into the intake system (not shown) of the engine system 100 to be combusted. Air flows through the air line 126 to the DCV 128, which is initially closed in position. The engine control module 106 controls the DCV 128 to selectively enable air to flow through the air line 130 into the canister 118.

The air line 126 may include an evaporative leak check module (ELCM) 140. An ELCM filter 141 may filter the air flow to the ELCM 140. The evaporative leak check module 140 may include an ELCM diverter valve 142, a vacuum pump 144 and an ELCM pressure sensor 146. A reference orifice 148 may also be included within the evaporative leak check module 140. The diverter valve 142 includes a first path 150 and a second path 152 therethrough. In the first position 150, as illustrated, air is directed through the diverter valve directly from the input to the DCV 128. In the second position 152, the diverter valve 142 is controlled upward so that the vacuum pump 144 is in use and air travels through the vacuum pump 144 to the diurnal control 128. In either case, the pressure sensor 146 generates a pressure signal corresponding to the pressure within the ELCM 140.

The engine control module 106 regulates operation of the engine system 100 based on various system operating parameters. The engine control module 106 controls and is in communication with the MRA 114, the fuel tank pressure sensor 164, the PV 122, the DCV 128 and the ELCM 140.

Figure 2:
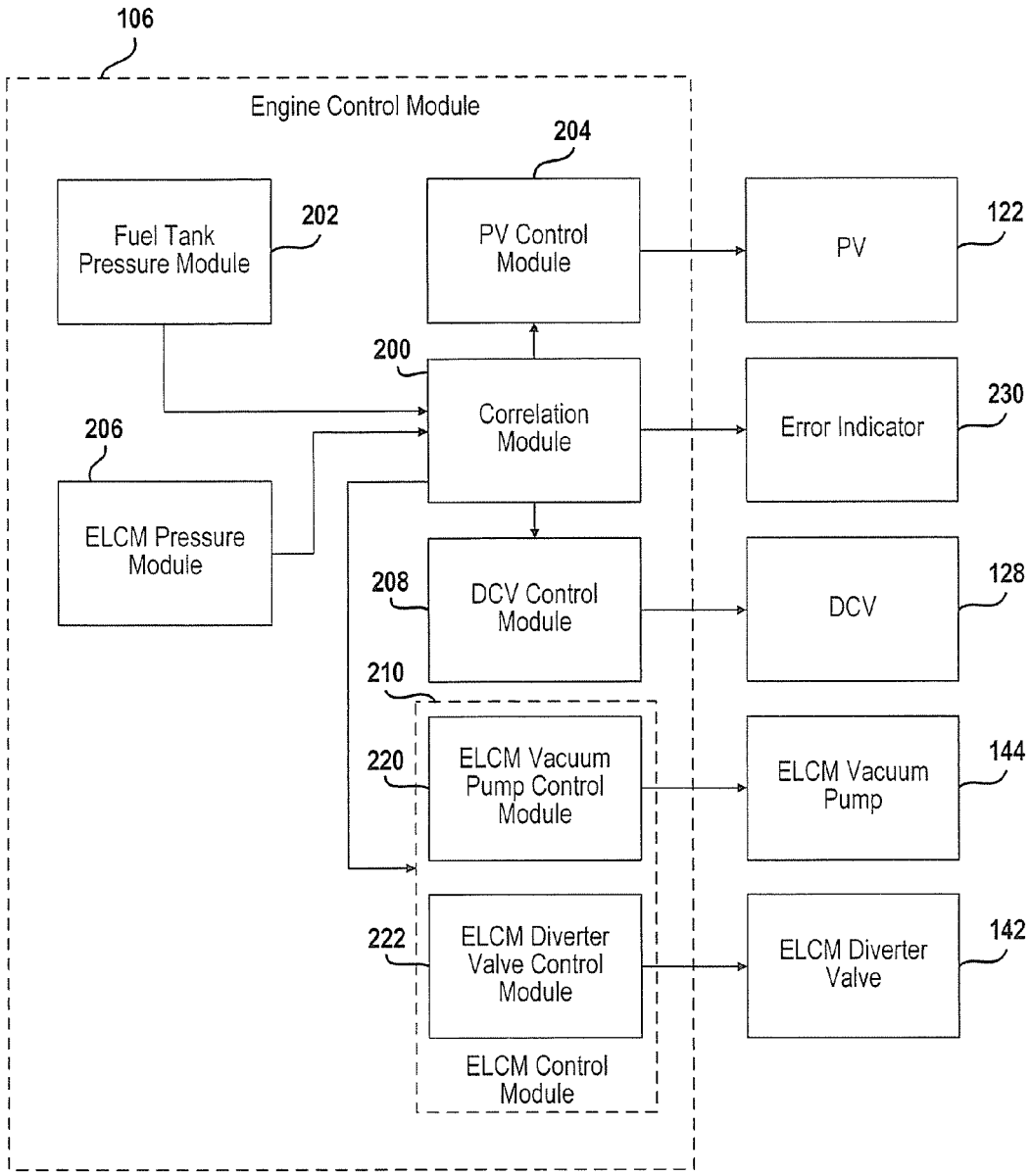
FIG. 2 is a functional block diagram of an engine control module according to the principles of the present disclosure.

Referring now to FIG. 2, a functional block diagram of the engine control module 106 is shown. The engine control module 106 includes a correlation module 200, a fuel tank pressure module 202, a PV control module 204, an evaporative leak check module (ELCM) pressure module 206, a DCV control module 208 and an ELCM control module 210.

The fuel tank pressure module 202 receives the fuel tank pressure signal and determines a fuel tank pressure based on the fuel tank pressure signal.

The ELCM pressure module 206 generates a pressure corresponding to the evaporative leak check module pressure sensor 146 of FIG. 1. The ELCM pressure signal and the fuel tank pressure are provided to the correlation module 200. The correlation module 200 provides control signals to the purge valve control module 204 that controls purge valve 122. The correlation module 200 also provides control signals to the diurnal control valve control module 208. The purge valve control module 204 controls the purge valve 122 as will be described below during a correlation of the pressure sensors. Likewise, the DCV control module 208 controls the DCV 128 during correlation of the pressure sensors.

The ELCM control module 210 includes an ELCM vacuum pump control module 220 and an ELCM diverter valve control module 222. The ELCM vacuum pump control module 222 controls the ELCM vacuum pump 144 and the ELCM diverter valve control module controls the ELCM diverter valve 142.

The correlation module 200 controls the operation of the purge valve 122, the diurnal control valve 128, the ELCM diverter valve 142 and the vacuum pump 144 in a predetermined manner to provide a sensor correlation between the fuel tank pressure and the pressure measured at the ELCM pressure sensor 146 of FIG. 1. The correlation module 200 may, for example, determine a plurality of differences between the fuel tank pressure and the ELCM pressure and generates an average difference signal. The average difference signal may be compared to a correlation value or threshold. When the difference between the fuel tank and ELCM pressure is outside of a correlation range, an error indicator 230 may be activated. The error indicator 230 may provide an error signal through an on-board diagnostic system, or the like. The error indicator 230 may also be used to provide an audible or visual indicator as to an error to the vehicle operator.

Figure 3:
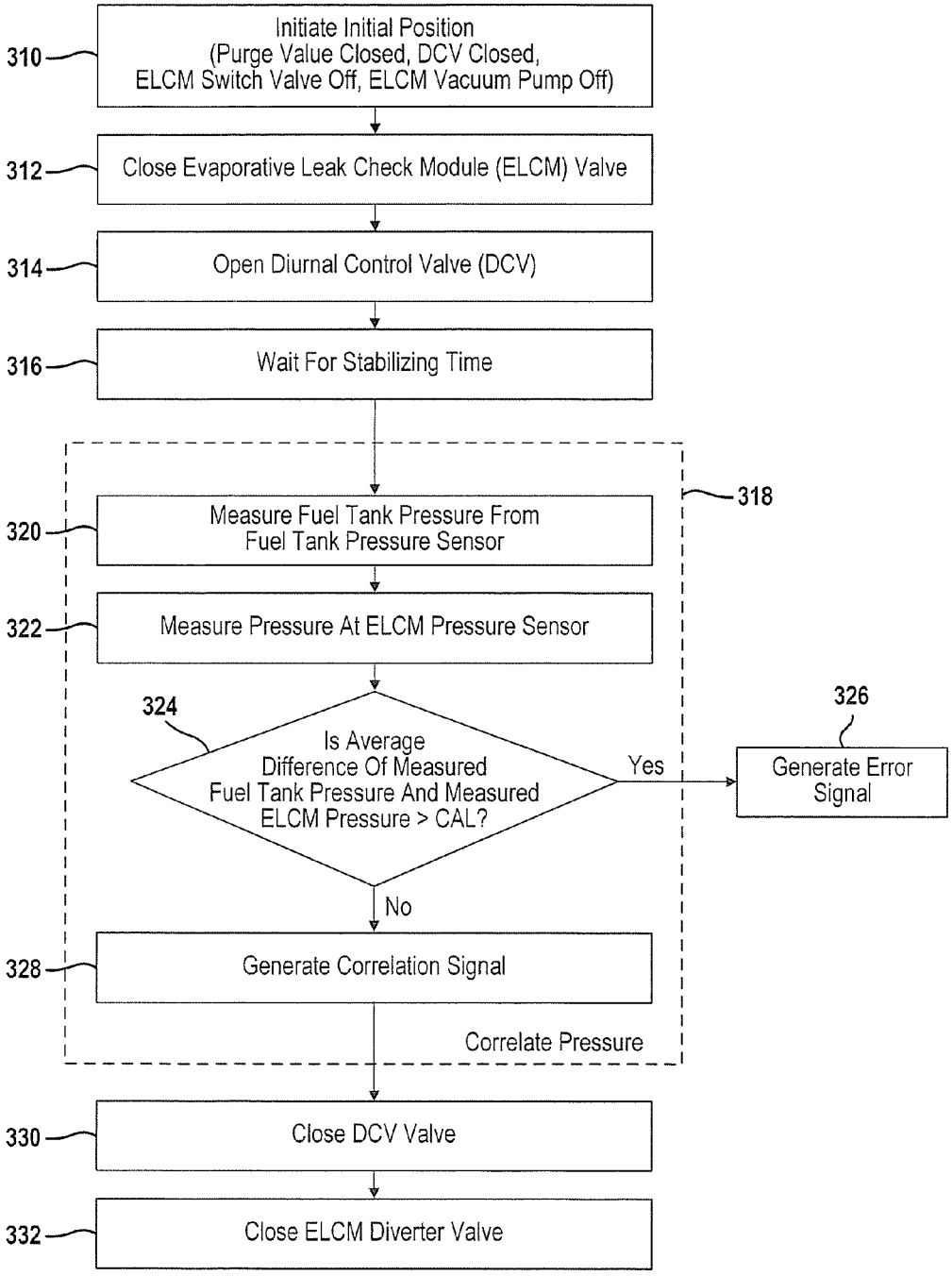
FIG. 3 is a flowchart depicting exemplary steps performed by the engine control module according to the principles of the present disclosure.

Referring now to FIG. 3, a method for operating the present disclosure is set forth. In step 310, the initial positions of the various valves are initiated. It should be noted that the present disclosure may be performed both in engine-running and engine-off states. In step 310, the initial positions correspond to the purge valve being closed, the diurnal control valve being closed, the diverter valve being off and the ELCM vacuum pump being off. At this point, no sensor correlation is taking place.

In step 312, the ELCM diverter valve is turned on which places the ELCM diverter valve in the upper-most position 152 illustrated in FIG. 1. In step 314, the DCV valve is opened. In step 316, the system waits for a stabilization time. The stabilizing time allows the system to equalize prior to pressure measurement. In step 318, the pressure sensor signals are correlated.

The correlation of the pressure sensors in step 318 includes many steps including step 320 that measures the fuel tank pressure from the fuel tank pressure sensor. In step 322, the pressure at the ELCM pressure sensor is determined. In step 324, a difference of the measured fuel tank pressure and the measured ELCM pressure is determined. The difference may be obtained several times over a range of times and an average difference may be determined. When the average difference is greater than a calibration threshold (CAL) in step 324, step 326 generates an error signal. In step 324, when the difference is not greater than a calibration, a correlation signal is generated in step 328. After step 328, the DCV valve is closed in step 330 and the ELCM diverter valve is closed in step 332.

As will be evident to those skilled in the art, an additional pressure sensor for verifying the proper operation of the fuel tank pressure sensor is not provided. By providing the same pressure to the fuel tank pressure sensor and the ELCM pressure sensor, both of the sensors are exposed to the same pressure/vacuum environment and therefore a correlation of the two sensors may be performed.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A method comprising:

switching on an evaporative leak check module (ELCM), diverter valve;

opening a diurnal control valve after switching on the ELCM diverter valve;

after opening the diurnal control valve, generating a fuel tank pressure signal;

generating an ELCM pressure signal;

correlating the ELCM pressure signal and the fuel tank pressure signal; and generating a fault signal in response to the correlating.

2. A method as recited in claim 1 further comprising prior to correlating, discontinuing operation of an ELCM vacuum pump.

3. A method as recited in claim 1 further comprising prior to correlating, closing a purge valve.

4. A method as recited in claim 1 further comprising closing the diurnal control valve after the correlating.

5. A method as recited in claim 1 wherein:

generating the fuel tank pressure signal comprises generating a plurality of fuel tank pressure signals;

generating the ELCM pressure signal comprises generating a plurality of ELCM pressure signals; and correlating the ELCM pressure signal and the fuel tank pressure signal comprises correlating the plurality of ELCM pressure signals and the plurality of fuel tank pressure signals.

6. A method as recited in claim 5 wherein correlating the ELCM pressure signal and the fuel tank pressure signal comprises determining a plurality of differences of respective ELCM pressure signals of the plurality of ELCM pressure signals and respective fuel tank pressure signals of the plurality of fuel tank pressure signals.

7. A method as recited in claim 6 further comprising determining an average of the plurality of differences and comparing the average to a threshold.

8. A method as recited in claim 6 further comprising comparing the plurality of differences to a threshold.

9. A method as recited in claim 1 further comprising switching off the ELCM diverter valve after the correlating.

10. A method as recited in claim 1 wherein generating the fault signal comprises generating a fuel tank pressure sensor fault signal.

11. A method as recited in claim 1 wherein:

the ELCM pressure signal is generated using an ELCM pressure sensor, the fuel tank pressure signal is generated using a fuel tank pressure sensor, the ELCM diverter valve has an on state and an off state, in the on state, the ELCM diverter valve connects the ELCM pressure sensor to an air line, and when the diurnal control valve is open, the air line is connected to the fuel tank pressure sensor.

12. A control module comprising:

a diurnal control valve module that opens a diurnal control valve;

an evaporative leak check module (ELCM) diverter valve control module that switches on an ELCM diverter valve; and a correlation module (i) that performs a correlation of an ELCM pressure signal and a fuel tank pressure signal and (ii) that generates a fault signal in response to the correlation when the diurnal control valve is open and the ELCM diverter valve is on.

13. A control module as recited in claim 12 further comprising a purge valve control module that closes a purge valve, wherein the correlation module performs the correlation when the purge valve is closed.

14. A control module as recited in claim 12 further comprising an ELCM vacuum pump control module that discontinues operation of an ELCM vacuum pump, wherein the correlation module performs the correlation when the ELCM vacuum pump is not in operation.

15. A control module as recited in claim 12 wherein the correlation module performs a correlation of a plurality of ELCM pressure signals and a plurality of fuel tank pressure signals.

16. A control module as recited in claim 15 wherein the correlation module performs a correlation of a plurality of differences of respective ELCM pressure signals of the plurality of ELCM pressure signals and respective fuel tank pressure signals of the plurality of fuel tank pressure signals.

17. A control module as recited in claim 16 wherein the correlation module compares an average of the plurality of differences and compares the differences to a threshold.

18. A control module as recited in claim 12 wherein the ELCM diverter valve control module that switches the ELCM diverter valve off after correlating.

19. A control module as recited in claim 12 wherein the fault signal comprises a fuel tank pressure sensor fault signal.

20. A system comprising the control module as recited in claim 13 and further comprising:

an ELCM pressure sensor that generates the ELCM pressure signal;

a fuel tank pressure sensor that generates the fuel tank pressure signal; and an air line connected between the diurnal control valve and the ELCM diverter valve, wherein the ELCM diverter valve has an on state and an off state, in the on state, the ELCM diverter valve connects the ELCM pressure sensor to the air line, and when the diurnal control valve is open, the air line is connected to the fuel tank pressure sensor.

* * * * *